US006098020A

United States Patent [19]

den Boer

[11] Patent Number: 6,098,020

[45] Date of Patent: Aug. 1, 2000

[54] DOWNHOLE MONITORING METHOD AND DEVICE

[75] Inventor: Johannis Josephus den Boer, Rijswijk, Netherlands

[73] Assignee: Shell Oil Company, Houston, Tex.

[21] Appl. No.: 09/056,960

[22] Filed: Apr. 8, 1998

[30] Foreign Application Priority Data

Apr. 9, 1997 [EP] European Pat. Off. ..... 97201092

[51] Int. Cl.[7] ..... G06F 19/00

[52] U.S. Cl. ..... 702/12; 73/152.26

[58] Field of Search ..... 702/12, 13; 73/152.06, 73/152.17, 152.24, 152.26, 152.36, 152.28, 152.55, 152.37; 324/324, 325, 333, 368; 166/66, 264, 250.01, 250.03, 254.2, 254.1

[56] References Cited

U.S. PATENT DOCUMENTS

| | | | |
|---|---|---|---|
| 2,564,198 | 8/1951 | Elkins | 73/155 |
| 2,605,637 | 8/1952 | Rhodes | 73/151 |
| 2,781,663 | 2/1957 | Maly et al. | 73/152.26 |
| 2,973,477 | 2/1961 | Lerner | 324/61 |
| 4,677,386 | 6/1987 | Chapman et al. | 324/366 |
| 5,132,903 | 7/1992 | Sinclair | 364/422 |
| 5,233,304 | 8/1993 | Hubans | 324/333 |
| 5,597,042 | 1/1997 | Tubel et al. | 166/250.01 |
| 5,642,051 | 6/1997 | Babour et al. | 324/357 |
| 5,829,520 | 11/1998 | Johnson | 166/250.01 |

FOREIGN PATENT DOCUMENTS

| | | | |
|---|---|---|---|
| 0111353 | 6/1984 | European Pat. Off. . | |
| 1322402 | 2/1963 | France . | |
| 2 435 025 | 3/1980 | France | G01L 7/08 |
| 2621142 | 11/1977 | Germany . | |
| WO 96/23957 | 8/1996 | WIPO | E21B 47/00 |

*Primary Examiner*—Donald E. McElheny, Jr.

[57] ABSTRACT

A method and device are provided for monitoring the interfaces between and other physical characteristics of fluids in the pore spaces of an underground formation. The device includes a sleeve around which, when in use, an annular measuring chamber is formed which is in fluid communication with the pore spaces of the surrounding formation but which is hydraulically isolated from other parts of the wellbore of a production or other well in which the device is mounted. An array of capacitor or other sensors is mounted in the measuring chamber for measuring the interfaces between, or other physical characteristics of, the fluids in the measuring chamber.

4 Claims, 3 Drawing Sheets

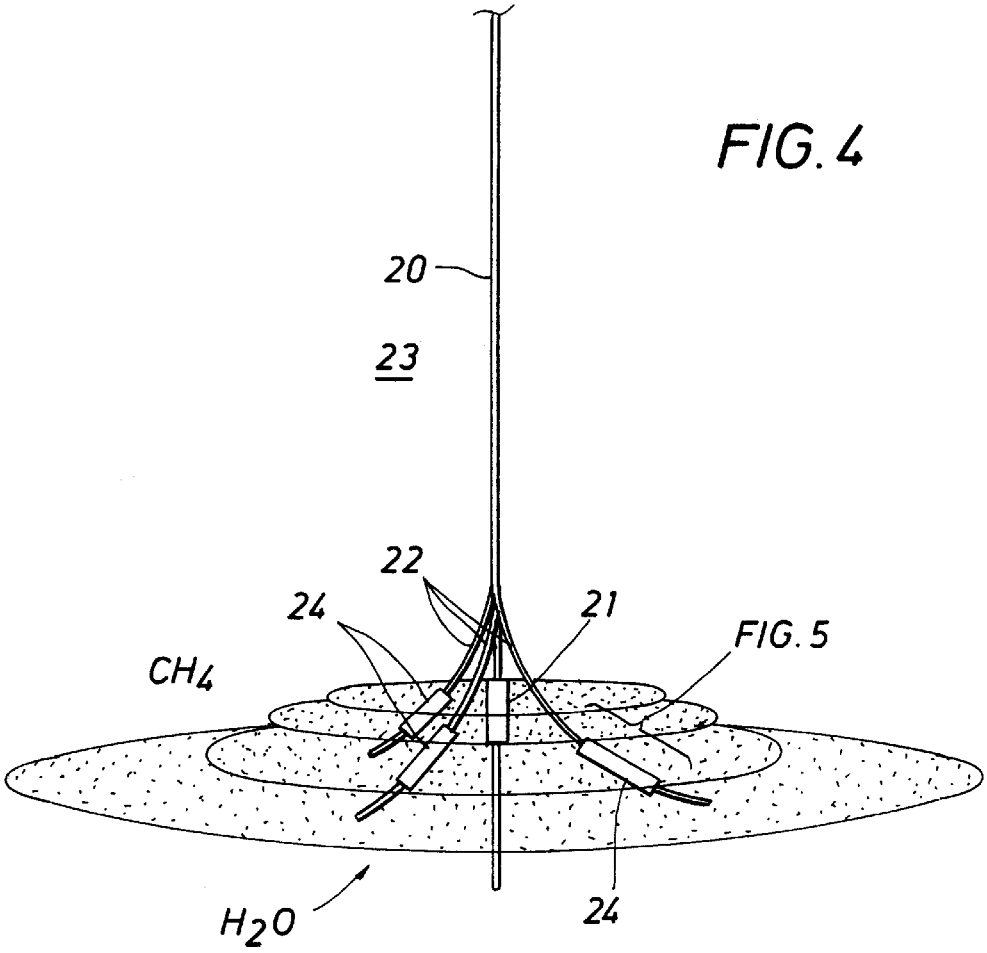
FIG. 4
20
23
22
24
21
FIG. 5
$CH_4$
$H_2O$
24
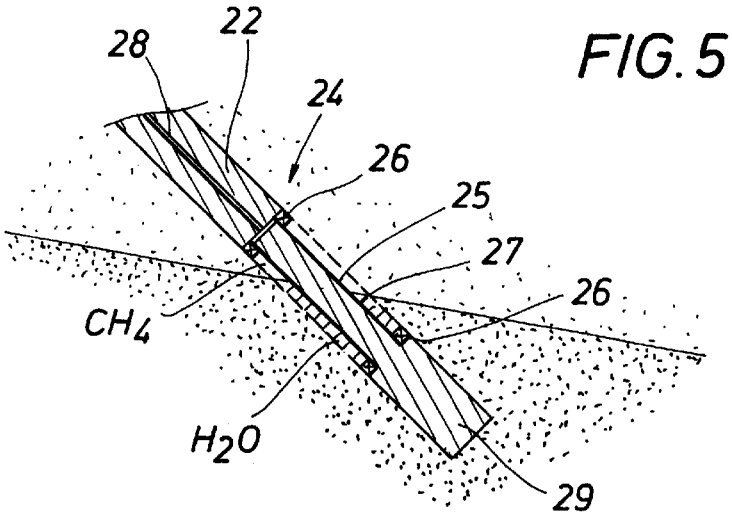
FIG. 5
28
22
24
26
25
27
26
$CH_4$
$H_2O$
29

FIG. 6
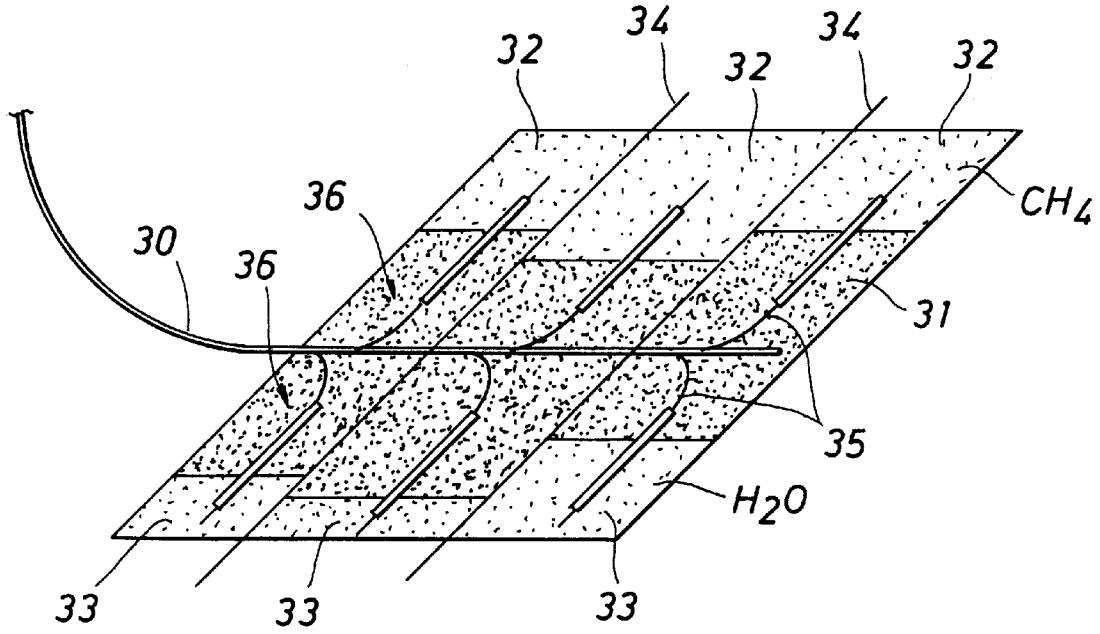
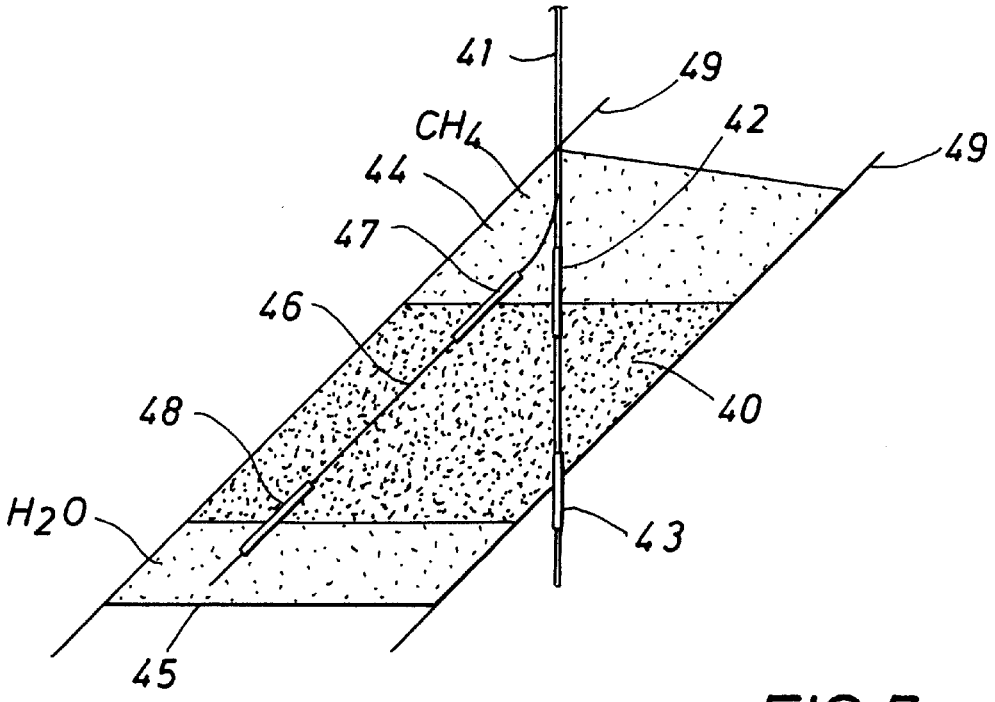
FIG. 7

DOWNHOLE MONITORING METHOD AND DEVICE

FIELD OF THE INVENTION

The invention relates to a method and device for downhole monitoring of physical characteristics of fluids.

More particularly the invention relates to a method and device for monitoring physical characteristics of fluids in the pore spaces of an underground formation surrounding a wellbore.

BACKGROUND TO THE INVENTION

When fluids, such as crude oil and natural gas, are produced it is often desirable to measure at downhole locations physical characteristics of the produced fluid(s) in order to ensure optimum production. Relevant characteristics are the pressure, temperature and composition of the fluid. Fluid composition monitoring is useful in reservoir formations where water or gas coning occurs around the well or wells through which crude oil is produced. In such reservoir formations it is therefore particularly relevant to continuously monitor the location(s) of the oil, gas and/or water interfaces at a variety of downhole locations.

Various methods exist to monitor fluid characteristics downhole.

U.S. Pat. No. 2,564,198 discloses a method wherein the in flow section of producing well is divided into a number of subsections by a removable well testing apparatus. The apparatus is equipped with a series of expandable packers.

The composition of the fluid that flows into each subsection is monitored by a fluid identifier unit which may measure the electrical conductivity of the produced fluid.

U.S. Pat. No. 5,132,903 discloses a method wherein a removable measuring sonde is lowered into the inflow region of an oil production well and a pad can be forced against the borehole wall to provide a sealed chamber from which fluid is evacuated by a pump and the properties of the thus withdrawn pore fluid(s) are measured. This method allows determination of the oil/water concentrations on the basis of a measurement of the dielectric properties of the produced fluids. Other dielectric well logging devices are disclosed in U.S. Pat. Nos. 2,973,477 and 4,677,386, German patent specification 2621142 and European patent specification 0111353.

A disadvantage of the known monitoring techniques is that use is made of measuring equipment which is temporarily lowered into the wells to perform the measurements and that these methods primarily measure characteristics of fluids that are flowing into the well.

An object of the present invention is to provide a method and device which enable a continuous downhole measurement of in-situ characteristics of the fluids in the pore spaces of the formation surrounding the wellbore.

Further objects of the present invention are to provide a downhole fluid monitoring method which can be carried out by means of a measuring device which can be easily installed at any location within a wellbore in such a way that it does not obstruct access to and/or production from lower parts of the well and which can be easily removed or replaced.

SUMMARY OF THE INVENTION

The method according to the invention comprises creating in the wellbore a measuring chamber which is in fluid communication with the pore spaces of the formation but which is hydraulically isolated from the rest of the wellbore, thereby creating a body of substantially stagnant fluid in the chamber and measuring physical characteristics of the fluid in the chamber by means of a number of sensors that are mounted within the chamber.

It is preferred that the sensors are capacitive sensors which are suitable for detecting the presence of water, crude oil and/or natural gas in the region of the sensor and that a string of sensors is arranged in the chamber which sensors are axially spaced with respect to a longitudinal axis of the wellbore and which sensors are connected to fluid level monitoring equipment which is adapted to identify the presence and location of an interface between different fluids, such as water, crude oil and/or natural gas in the region of the string of sensors.

Furthermore it is preferred that the measuring chamber is an annular chamber which is isolated from the rest of the wellbore by means of a fluid tight sleeve and a pair of axially spaced packers that are arranged between the sleeve and an inner surface of the wellbore.

The fluid monitoring device according to the invention comprises a sleeve for creating in the wellbore measuring chamber which, when in use, is in fluid communication with the pore spaces of the formation but which is hydraulically isolated by the sleeve and packers mounted on the sleeve from the rest of the wellbore thereby creating a body of substantially stagnant fluid in the chamber, and a plurality of sensors that are mounted within the chamber for measuring physical characteristics of the fluid inside the chamber.

BRIEF DESCRIPTION OF THE FIGURES

FIG. 4 is a schematic representation of a vertical well and of a series of slimhole side-track wells, which wells are equipped with fluid monitoring devices according to the invention.

FIG. 5 is a longitudinal sectional view showing at an enlarged scale the fluid monitoring device in one of the sidetrack wells of FIG. 4.

FIG. 6 is a schematic vertical sectional view of a horizontal oil production well and of six slimhole side-track wells, where each side-track well is equipped with a fluid monitoring device according to the invention.

FIG. 7 is a schematic vertical sectional view of a vertical oil production well and a slimhole side-track well which are each provided with a pair of fluid monitoring devices according to the invention.

DESCRIPTION OF A PREFERRED EMBODIMENT

Figure 1:
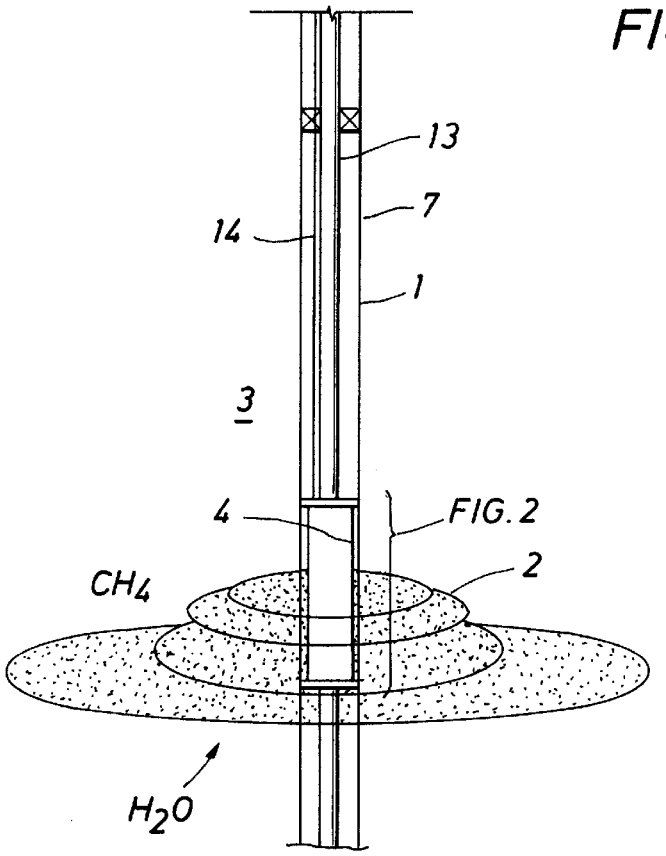
FIG. 1 is a schematic representation of an oil production well in which the downhole fluid monitoring method and device according to the invention are used.

Referring now to FIG. 1 there is shown a production well 1 via which natural gas (referred to as CH4 in the drawings) is produced. As a result of the reduced fluid pressure in the region of the well 1 water coning takes place and a cone 2 of water (referred to as H2O in the drawings) is formed in the pore spaces of the lower part of the reservoir formation 3 surrounding the well 1.

In order to monitor the presence of water in the pore spaces of the reservoir formation 3 and/or to monitor other characteristics of the pore fluids a downhole monitoring device 4 according to the invention is installed in the well 1.

Figure 2:
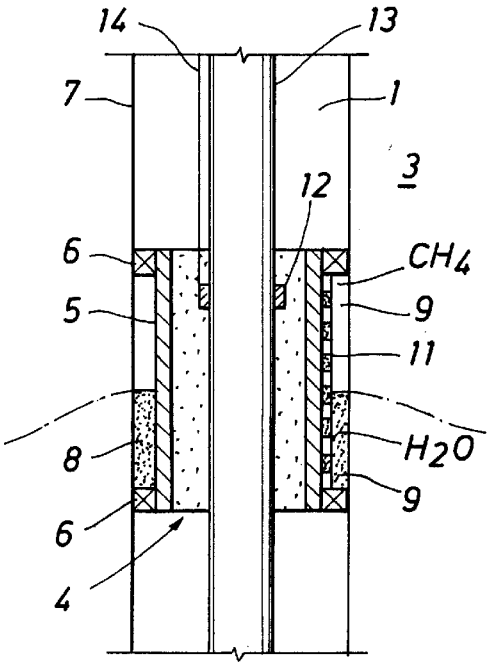
FIG. 2 is a vertical sectional view of the well of FIG. 1 showing at a larger scale than in FIG. 1 details of the fluid monitoring device according to the invention.

As shown in more detail in FIG. 2 the monitoring device comprises a tubular sleeve 5 which is equipped with a pair of packers 6. The packers are expanded once the sleeve 5 has been lowered to the location where the measurements are to be made to seal off the upper and lower ends of the annular space between the sleeve 5 and a well casing 7, thereby forming an annular measuring chamber 8 which is hydraulically isolated from the rest of the wellbore. Before installation of the device 4 the well casing 7 has been provided with perforations 9 via which the fluid in the pores of the reservoir formation 3 surrounding the device 4 is given free access to the measuring chamber 8.

As no fluid is produced from the measuring chamber 8 the fluid in the chamber 8 is substantially stagnant and an equilibrium is established between the gas/water ($CH_4$/$H_2O$) interface 10 in the measuring chamber 8 and the gas/water interface in the surrounding reservoir formation 3. Hence the gas/water or other fluid interface in the reservoir formation 3 surrounding the well 1 can be monitored from inside of the measuring chamber 8 using an array of capacitor sensors 11 that are embedded in, or mounted on, the outer surface of the sleeve 5.

Figure 3:
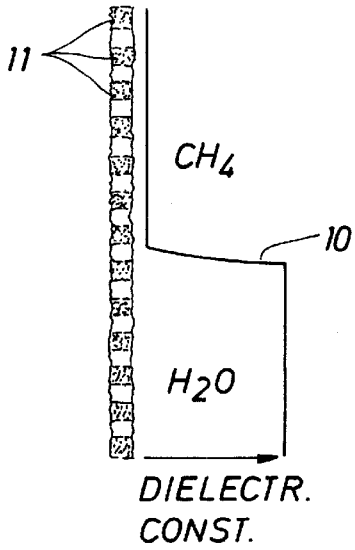
FIG. 3 shows in detail and at a further enlarged scale the array of capacitance sensors of the fluid monitoring device of FIG. 2 and showing the variation of the dielectric constant measured by the sensors at the gas-water interface.

FIG. 3 shows at a further enlarged scale the array of capacitor sensors 11 and illustrates the variation of dielectric constants measured at the gas/water interface 10. Since the dielectric constant of water is about 80 times larger than the dielectric constant of natural gas a high resolution of the device as an interface monitor is possible.

Capacitor sensors 11 are known in the art and are being used for interface detection in e.g. storage tanks and will therefore not be described in detail. The use of capacitor sensors 11 requires simple, non-sensitive electronics downhole and needs but low electrical power.

The vertical resolution that can be achieved with this type of sensors is in the order of a few mm.

As shown in FIG. 2 the data transfer from and power supply to the monitoring device 4 is performed by an inductive coupler 12 installed on a production or other tubing 13 at a location adjacent to the device 4.

The inductive coupler 12 is connected to surface electronics (not shown) through an electrical cable 14.

If the device 4 is installed above the lowermost casing-tubing packer (not shown) the production tubing 13 can be used to install the inductive coupler 12 and to clamp on the electrical cable 14. If the device 4 is to be installed below the lowermost casing-tubing packer (not shown) a tail pipe or other well tubular may be used for this purpose.

Alternatively a cable-less communication system, such as an acoustic system or a system that uses the tubing as an antenna may be used for the data transfer from and power supply to the monitoring device 4. The device 4 can therefore be easily installed in both existing and new wells for permanent downhole use.

In addition to or instead of capacitor sensors 11 the device can also be equipped with other sensors for measuring physical characteristics of the pore fluids, such as pressure and temperature.

Being a stand alone unit, the monitoring device 4 offers high installation flexibility and is but a small obstruction in the wellbore. Due to its tubular design free access to the wellbore below the device 4 is provided. This also allows the use of several monitoring devices 4 at various depths in a single well 1, e.g. to monitor the fluid interfaces of stacked reservoirs and/or to monitor the oil/water interface below, and the oil/gas interface above, an oil bearing reservoir formation. In reservoirs where steam or other fluid injection takes place the device 4 may be used to monitor a breakthrough of steam or another injection fluid into the production well 1.

Frequently there is a need to image the fluid interfaces and other characteristics of the pore fluids in reservoir formations at a distance from a production well.

FIG. 4 shows a vertical production well 20 in which a monitoring device 21 which is similar to the device 4 of FIGS. 1–3 is mounted. In order to enable fluid interface monitoring at a distance from the production well 20 three slimhole side-track wells 22 have been drilled into the reservoir formation 23. Each side-track well 22 is equipped with a monitoring device 24 which is shown at an enlarged scale in FIG. 5.

As shown in FIG. 5 the device 24 comprises a tubular sleeve 25 which is equipped with a pair of expandable packers 26 that are pressed against the formation surrounding the wellbore of the side track well 22.

Thus an annular measuring chamber 27 is formed around the sleeve 25 and between the packers 26 to which chamber 27 pore fluids from the surrounding formation have free access but which chamber is hydraulically isolated from the rest of the wellbore.

The outer surface of the sleeve 25 is equipped with an array of capacitor and/or other sensors (not shown) which operate in the same manner as described with reference to FIGS. 1–3.

The array of sensors is connected to means for displaying the measured fluid characteristics at the surface (not shown) by means of one or more electrical or optical signal transmission cables 28. Once the monitoring devices 24 and transmission cables 28 are installed the side-track wells are, except the measuring chambers 27, fully filled with cement 29 to prevent uncontrolled production via the side-track wells 22. Thus, the monitoring devices 24 are buried in the reservoir formation.

The well and sensor configuration shown in FIGS. 4 and 5 is suitable for monitoring the gas/water ($CH_4$/$H_2O$) interface at various locations in and at various distances away from the gas production well 20 which allows an adequate mapping of the variations of the gas/water interface throughout the reservoir formation 23 as a result of water coning or other reservoir depletion effects.

FIG. 6 shows a schematic vertical sectional view of a horizontal oil production well 30 which extends through an oil bearing reservoir formation 31.

Above and below the oil bearing formation 31 there are gas ($CH_4$) bearing and water ($H_2O$) bearing formations 32 and 33, respectively.

A pair of parallel faults 34 exist in the reservoir and surrounding formations and as a result of variations in the fluid flow conditions the oil/water and gas/oil interfaces are different at each side of each fault 34.

In order to monitor the locations of the oil/water and gas/oil interfaces at each side of the faults 34 a series of six slimhole side-track wells 35 have been drilled into the reservoir formation 31 in a direction substantially parallel to the faults 34.

Each side-track well 35 is equipped with an elongate monitoring device 36 of the same type as described in detail with reference to FIG. 5 and the other parts of the side-track wells 35 are filled with cement to prevent uncontrolled production via the side-track wells 35. The well and sensor configuration shown in FIG. 6 enables an adequate and continuous mapping of the oil/water and oil/gas and/or gas/water surfaces in a faulted reservoir formation which is traversed by a horizontal or inclined production well.

FIG. 7 is a schematic vertical sectional view of a faulted oil bearing reservoir formation 40 which is traversed by a vertical oil production well 41 which is equipped with an upper and a lower monitoring device 42 and 43, respectively, which devices are of the same type as shown in FIG. 2. Above and below the oil bearing formation 40 there are gas (CH4) and water (H2O) bearing strata 44 and 45, respectively. The monitoring devices 42 and 43 are located in the regions of the oil/gas and oil/water interfaces in the reservoir formation 40 in the vicinity of the production well 41. A slimhole sidetrack well 46 has been drilled from the production well 41 into the reservoir formation 40 in a direction substantially parallel to the faults 49.

The side-track well 46 contains an upper and a lower monitoring device 47 and 48, respectively, for monitoring the gas/oil and oil/water interface at the top and bottom of the oil bearing reservoir formation. The monitoring devices 47 and 48 are of the same type as shown in FIG. 5 and the other parts of the side-track well 46 are cemented to prevent uncontrolled production via the side-track well 46.

The well and sensor configuration shown in FIG. 7 enables an adequate and continuous mapping of the gas/oil and oil/water interfaces in a faulted reservoir formation 40 which is traversed by a vertical or inclined oil production well 41.

It will be understood by those skilled in the art that the monitoring device and method according to the present invention can be used to monitor the gas, oil and/or water interfaces at any desired location in an underground formation. They can be used to improve and update the reservoir models and make real-time reservoir imaging and management possible.

I claim:

1. A method for monitoring physical characteristics of fluids in the pore spaces of an underground formation surrounding a wellbore, the method comprising the steps of:

creating in the wellbore a measuring chamber which is in fluid communication with the pore spaces of the formation but which is hydraulically isolated from the rest of the wellbore, thereby creating a body of substantially stagnant fluid in the chamber; and, measuring physical characteristics of the fluid in the chamber by means of a plurality of sensors that are mounted within the chamber:

wherein the sensors are capacitive sensors which are effective to detect the presence of water, crude oil and/or natural gas in the region of the sensor;

wherein a string of sensors is arranged in the chamber which sensors are axially spaced with respect to a longitudinal axis of the wellbore and which sensors are connected to fluid level monitoring equipment which is adapted to identify the presence and location of an interface between different fluids, such as water, crude oil and/or natural gas in the region of the string of sensors; and, wherein the measuring chamber is an annular chamber which is isolated from the rest of the wellbore by means of a fluid tight sleeve and a pair of axially spaced packers that are arranged between the sleeve and an inner surface of the wellbore.

2. The method of claim 1, wherein the well is an oil and/or gas production well and a plurality of axially spaced measuring chambers are created at various locations in the well.

3. The method of claim 1, wherein the well is a slimhole side-track well which is apart from the measuring chamber substantially filled with a body of cement to prevent production of fluids via the side-track well.

4. A device for monitoring physical characteristics of fluids in the pore spaces of an underground formation surrounding a wellbore, the device comprising:

a sleeve for creating in the wellbore measuring chamber which, when in use, is in fluid communication with the pore spaces of the formation but which is hydraulically isolated by the sleeve and packers mounted on the sleeve from the rest of the wellbore thereby creating a body of substantially stagnant fluid in the chamber; and a plurality of sensors that are mounted within the chamber for measuring physical characteristics of the fluid inside the chamber.

* * * * *